US010753559B2

(12) United States Patent
Crosby et al.

(10) Patent No.: US 10,753,559 B2
(45) Date of Patent: Aug. 25, 2020

(54) LIGHTING FIXTURES

(71) Applicant: Boyd Lighting Fixture Company, Sausalito, CA (US)

(72) Inventors: Doyle Crosby, San Rafael, CA (US); Mark A. Gaynor, San Francisco, CA (US)

(73) Assignee: Boyd Lighting Fixture Company, Sausalito, CA (US)

( * ) Notice: Subject to any disclaimer, the term of this patent is extended or adjusted under 35 U.S.C. 154(b) by 0 days.

Patent file contains an affidavit/declaration under 37 CFR 1.130(b).

(21) Appl. No.: 16/045,071

(22) Filed: Jul. 25, 2018

(65) Prior Publication Data

US 2019/0032872 A1 Jan. 31, 2019

Related U.S. Application Data

(60) Provisional application No. 62/537,766, filed on Jul. 27, 2017.

(51) Int. Cl.
*F21S 8/02* (2006.01)
*F21V 21/04* (2006.01)
(Continued)

(52) U.S. Cl.
CPC ..... *F21S 8/026* (2013.01); *F21V 7/0008* (2013.01); *F21V 21/04* (2013.01);
(Continued)

(58) Field of Classification Search
CPC ..... F21S 8/026; F21V 21/04
See application file for complete search history.

(56) References Cited

U.S. PATENT DOCUMENTS

D185,410 S 6/1959 Bodian et al.
D247,562 S 3/1978 Walker
(Continued)

OTHER PUBLICATIONS

Sunbeam Sconce Fixture and Portal Sconce Fixture, "Boyd Lighting: Family Owned Lighting Firm", Mark McDonough, tastefullyinspired.com, Oct. 21, 2016, site visited Jul. 2, 2018, available online at https://tastefullyinspired.com/welcoming-a-new-lighting-designer-boyd-lighting/, 21 pages, Oct. 21, 2016.
(Continued)

*Primary Examiner* — Leah Simone Macchiarolo
(74) *Attorney, Agent, or Firm* — Heslin Rothenberg Farley and Mesiti PC

(57) ABSTRACT

The lighting fixtures include, for example, a peripherally-extending frame surrounding an opening and a rear member having a front facing surface disposed behind the rear opening. The front facing surface of the rear member is illuminated by a light source disposed behind the rearwardly-extending member when the light source is on so that light emission from the light source passes between the peripherally-extending frame and the front facing surface of the rear member, is reflected off the front facing surface of the rear member, and is directed through the opening in the peripherally-extending frame. When the lighting source is on and the illuminated front facing surface of the lighting fixture is viewed by an observer, the light source is hidden from view to the observer by the peripherally-extending frame. In some embodiments, the lighting fixtures may have an illumination effect.

21 Claims, 17 Drawing Sheets

(51) Int. Cl.

| | |
|---|---|
| ***F21V 7/00*** | (2006.01) |
| ***F21Y 103/00*** | (2016.01) |
| ***F21Y 103/33*** | (2016.01) |
| ***F21Y 115/10*** | (2016.01) |

(52) U.S. Cl.
CPC ..... *F21Y 2103/00* (2013.01); *F21Y 2103/33* (2016.08); *F21Y 2115/10* (2016.08)

(56) References Cited

U.S. PATENT DOCUMENTS

| | | | | |
|---|---|---|---|---|
| D354,579 | S | 1/1995 | Chan | |
| D382,663 | S | 8/1997 | Barry | |
| 5,709,460 | A * | 1/1998 | Lester | F21S 8/02 362/147 |
| D394,726 | S | 5/1998 | Crosby | |
| D402,074 | S | 12/1998 | Crosby | |
| D403,796 | S | 1/1999 | Crosby | |
| D407,521 | S | 3/1999 | Crosby | |
| D436,468 | S | 1/2001 | Hutton et al. | |
| D441,119 | S | 4/2001 | Crosby | |
| D454,971 | S | 3/2002 | Crosby | |
| D455,223 | S | 4/2002 | Crosby | |
| D456,550 | S | 4/2002 | Clodagh | |
| D456,932 | S | 5/2002 | Crosby | |
| D459,525 | S | 6/2002 | Barry | |
| D475,802 | S | 6/2003 | Homann | |
| D494,305 | S | 8/2004 | Crosby | |
| D503,241 | S | 3/2005 | Crosby | |
| D532,146 | S | 11/2006 | Crosby | |
| D536,468 | S | 2/2007 | Crosby | |
| D536,820 | S | 2/2007 | Crosby | |
| D550,885 | S | 9/2007 | Crosby | |
| D558,912 | S | 1/2008 | Crosby | |
| D576,767 | S | 9/2008 | Gutkin | |
| D584,848 | S | 1/2009 | Menke | |
| D599,951 | S | 9/2009 | Pickard | |
| D606,227 | S | 12/2009 | Erickson | |
| D608,933 | S | 1/2010 | Castelli | |
| D632,003 | S | 2/2011 | Jordan | |
| D632,006 | S | 2/2011 | Jordan | |
| D633,644 | S | 3/2011 | Sprengers | |
| D646,424 | S | 10/2011 | Ho | |
| D646,425 | S | 10/2011 | Crosby | |
| D646,426 | S | 10/2011 | Wolk | |
| D658,327 | S | 4/2012 | Meise | |
| D663,467 | S | 7/2012 | Apetauer | |
| D663,468 | S | 7/2012 | Apetauer | |
| D674,952 | S | 1/2013 | Crosby | |
| D675,362 | S | 1/2013 | Apetauer | |
| D675,363 | S | 1/2013 | Apetauer | |
| 8,425,101 | B2 * | 4/2013 | Boonekamp | F21V 7/0008 362/609 |
| D681,863 | S | 5/2013 | Chen | |
| D682,455 | S | 5/2013 | Apetauer | |
| D684,288 | S | 6/2013 | Gielen | |
| D690,869 | S | 10/2013 | Katz | |
| D712,083 | S | 8/2014 | Crosby | |
| D712,963 | S | 9/2014 | Fleet | |
| D717,485 | S | 11/2014 | Lovegrove | |
| D718,484 | S | 11/2014 | Eberle | |
| D724,775 | S | 3/2015 | van Dijk | |
| D731,689 | S | 6/2015 | Bernard | |
| D759,873 | S | 6/2016 | Saaranen | |
| D762,906 | S | 8/2016 | Jeswani | |
| D768,327 | S | 10/2016 | Guzzini | |
| D768,903 | S | 10/2016 | Guzzini | |
| D769,501 | S | 10/2016 | Jeswani | |
| D769,504 | S | 10/2016 | Jeswani | |
| D772,466 | S | 11/2016 | Zhang | |
| D777,966 | S | 1/2017 | Jeswani | |
| D841,216 | S * | 2/2019 | Gaynor | D26/74 |
| 10,208,905 | B2 * | 2/2019 | Lavin | F21S 8/026 |
| 2007/0263393 | A1 * | 11/2007 | Van De Ven | F21V 29/2212 362/362 |
| 2011/0043132 | A1 * | 2/2011 | Kim | F21S 8/026 315/294 |
| 2012/0262902 | A1 * | 10/2012 | Pickard | F21S 8/026 362/84 |
| 2015/0085476 | A1 | 3/2015 | Mandy | |
| 2016/0375161 | A1 | 12/2016 | Hawkins et al. | |
| 2017/0082266 | A1 * | 3/2017 | Ruhland | F21V 7/0016 |
| 2017/0167672 | A1 | 6/2017 | Stauner | |
| 2017/0303363 | A1 | 10/2017 | Pyshos et al. | |
| 2018/0098399 | A1 * | 4/2018 | Takeshita | F21S 8/024 |
| 2018/0116029 | A1 | 4/2018 | Pyshos | |
| 2018/0335188 | A1 * | 11/2018 | Di Trapani | F21S 8/026 |
| 2019/0181545 | A1 * | 6/2019 | Lu | H01Q 1/44 |

OTHER PUBLICATIONS

Portal Sconce, contractdesign.com, site visited Jun. 29, 2018, available online at https://www.contractdesign.com/products/lighting-architectural/boyd-lighting-portal/, 4 pages, Oct. 5, 2017.

James Turrell Work Type, printed from the Internet Aug. 8, 2017, https://web.archive.org/web/20151122034440/http://jamesturrell.com:80/work/type/, 4 pages, Nov. 22, 2016.

James Turrell Veils, printed from the Internet Aug. 8, 2017, https://web.archive.org/web/20151218144150/http://jamesturrell.com:80/work/type/veils/, 2 pages, Dec. 18, 2015.

How to Pick Recessed Lighting, YDesign Group, LLC, printed from the Internet Aug. 8, 2017, 3 pages, May 22, 2010. May 22, 2010.

Doyle Crosby, Design U.S. Appl. No. 29/612,019, entitled Recessed Lighting Fixture, filed Jul. 27, 2017, 16-pages. Jul. 27, 2017

Doyle Crosby, Design U.S. Appl. No. 29/612,020, entitled Lighting Fixture Having an Illumination Effect, filed Jul. 27, 2017, 27-pages. Jul. 27, 2017.

Doyle Crosby, Design U.S. Appl. No. 29/612,018, entitled Lighting Fixture, filed Jul. 27, 2017, 13-pages. Jul. 27, 2017.

Doyle Crosby et al., U.S. Appl. No. 62/537,766, entitled Lighting Fixtures Having an Illumination Effect, filed Jul. 27, 2017, 43-pages. Jul. 27, 2017.

Mark A. Gaynor, Design U.S. Appl. No. 29/612,023, entitled Recessed Lighting Fixture , filed Jul. 27, 2017, 17-pages. Jul. 27, 2017.

Mark A. Gaynor, Design U.S. Appl. No. 29/612,024, entitled Lighting Fixture Having an Illumination Effect , filed Jul. 27, 2017, 15-pages. Jul. 27, 2017.

Mark A. Gaynor, Design U.S. Appl. No. 29/612,021, entitled "Lighting Fixture", filed Jul. 27, 2017, 13-pages. Jul. 27, 2017.

* cited by examiner

LIGHTING FIXTURES

CLAIM TO PRIORITY

This application claims the benefit of U.S. Provisional Application No. 62/537,766, filed Jul. 27, 2017, entitled "Lighting Fixtures Having An Illumination Effect", which is hereby incorporated herein by reference in its entirety.

CROSS REFERENCE TO RELATED APPLICATIONS

This application contains subject matter which is related to the subject matter of commonly owned U.S. Design patent application Ser. No. 29/612,018, entitled "Lighting Fixture" by Doyle Crosby; U.S. Design patent application Ser. No. 29/612,019, entitled "Recessed Lighting Fixture" by Doyle Crosby; and U.S. Design patent application Ser. No. 29/612,020, entitled "Lighting Fixture Having An Illumination Effect" by Doyle Crosby, which applications are hereby incorporated in their entirety herein by reference.

This application contains subject matter which is related to the subject matter of commonly owned U.S. Design patent application Ser. No. 29/612,021, entitled "Lighting Fixture" by Mark A. Gaynor; U.S. Design patent application Ser. No. 29/612,023, entitled "Recessed Lighting Fixture" by Mark A. Gaynor; and U.S. Design patent application Ser. No. 29/612,024, entitled "Lighting Fixture Having An Illumination Effect" by Mark A. Gaynor, which applications are hereby incorporated in their entirety herein by reference.

FIELD OF THE DISCLOSURE

The present disclosure relates generally to lighting fixtures, and more particularly lighting fixture such as lighting fixtures having a hidden light source and/or an illumination effect.

BACKGROUND

Conventional recessed lights or downlights are light fixtures that are installed into hollow openings in a ceiling. When installed it appears to have light shining from a hole in the ceiling, concentrating the light in a downward direction as a broad floodlight or narrow spotlight. There are three parts to recessed lighting fixtures, namely, a housing, a trim, and a bulb. The trim is the visible portion of the light fixture. It is the insert that is seen when looking up into the fixture, and also includes the thin lining around the edge of the light. The housing is the fixture itself that is installed inside the ceiling and contains the lamp holder. The bulb is inserted into recessed lighting fixtures and visible when viewed by an observer from below.

SUMMARY

Shortcomings of the prior art are overcome and additional advantages are provided through the provision, in one embodiment, of a lighting. The lighting fixture includes, for example, a peripherally-extending frame and a rear member. The peripherally-extending frame surrounds an opening. The rear member has a front facing surface disposed behind and spaced from the opening. A light source is disposed behind the peripherally-extending frame. The front facing surface of the rear member is unilluminated by the light source when the light source is off. The front facing surface of the rear member is illuminated by the light source when the light source is on so that light emission from the light source passes between the peripherally-extending frame and the front facing surface of the rear member, is reflected off the front facing surface of the rear member, and is directed through the opening in the peripherally-extending frame. When the lighting source is on and the illuminated front facing surface of the lighting fixture is viewed by an observer, the light source is hidden from view to the observer by the peripherally-extending frame.

In another embodiment, a method is provided. The method includes, for example, emitting light from a light source adjacent to a peripherally-extending frame having an edge surrounding an opening, passing the emitted light through a space between the edge surrounding the opening and a rear member, reflecting the emitted light from a front facing surface of the rear member, and passing the reflected light through the opening in the peripherally-extending member. When the light source is on and the illuminated front facing surface of the lighting fixture is viewed by an observer, the light source is hidden from view to the observer by the peripherally-extending frame.

BRIEF DESCRIPTION OF THE DRAWINGS

The subject matter which is regarded as the disclosure is particularly pointed out and distinctly claimed in the concluding portion of the specification. The disclosure, however, may best be understood by reference to the following detailed description of various embodiments and the accompanying drawings in which:

DETAILED DESCRIPTION

The present disclosure and certain features, advantages, and details thereof, are explained more fully below with reference to the non-limiting embodiments illustrated in the accompanying drawings. Descriptions of well-known materials, fabrication tools, processing techniques, etc., are omitted so as to not unnecessarily obscure the disclosure in detail. It should be understood, however, that the detailed description and the specific examples, while indicating embodiments of the present disclosure, are given by way of illustration only, and are not by way of limitation. Various substitutions, modifications, additions and/or arrangements within the spirit and/or scope of the underlying concepts will be apparent to those skilled in the art from this disclosure. Reference is made below to the drawings, which are not drawn to scale for ease of understanding, wherein the same reference numbers used throughout different figures designate the same or similar components.

The present disclosure is directed to lighting fixtures having a hidden light source and/or an illumination effect. For example, the lighting fixture of the present disclosure may be a recessed lighting fixture wherein a lighting source or lighting sources are hidden such as completely hidden from view by an observer, and a surface of the lighting fixture is utilized as a reflective surface for providing illumination from the lighting fixture.

Figure 1:
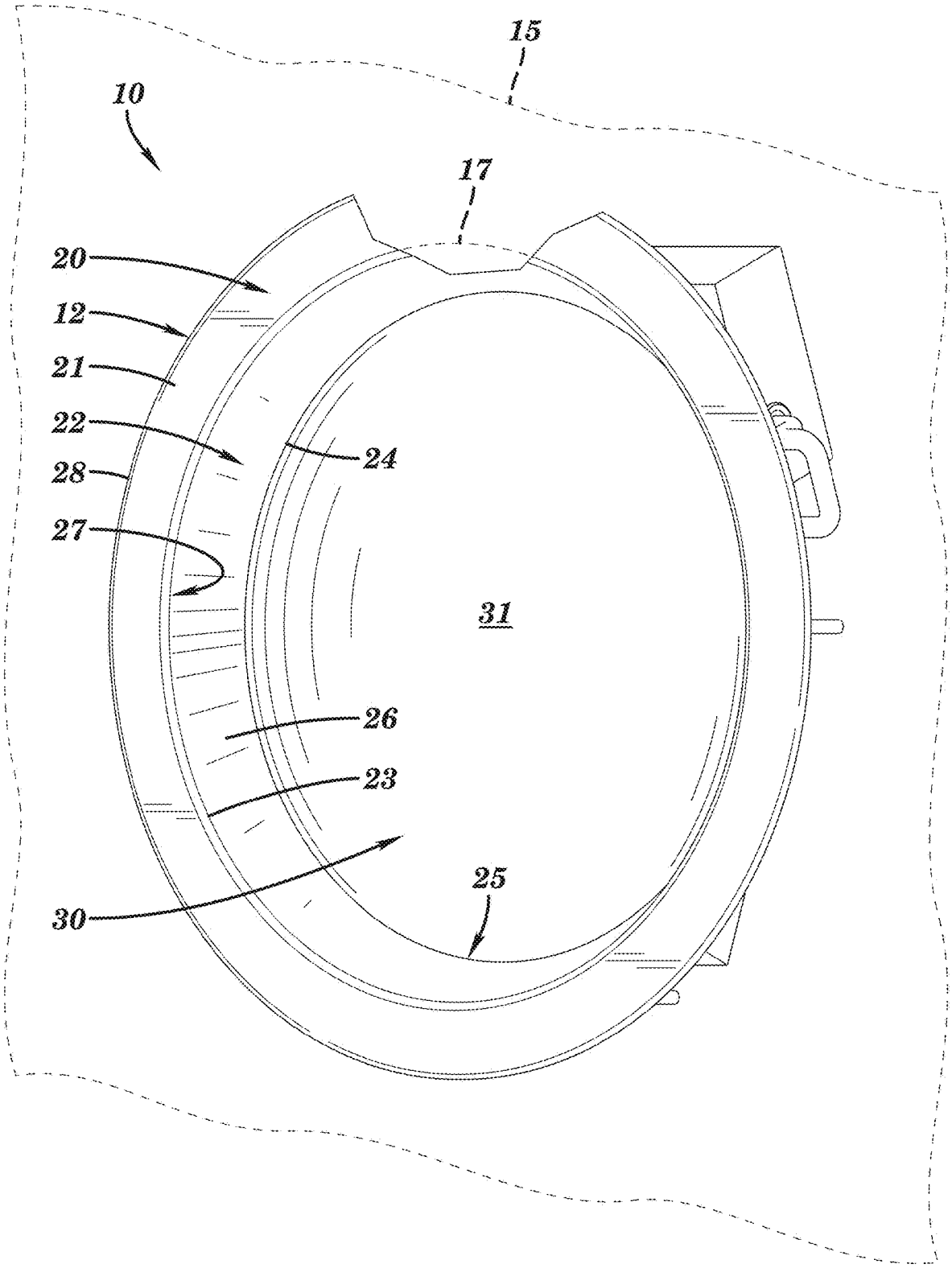
FIG. 1 is a perspective view of a lighting fixture according to an embodiment of the present disclosure, in which a light source of the lighting fixture is OFF so that the lighting fixture has an unilluminated configuration.

FIG. 1 illustrates a lighting fixture 10 according to an embodiment of the present disclosure illustrated in a non-illuminated or unilluminated configuration, i.e., in which a light source (not shown in FIG. 1) of lighting fixture 10 is OFF. Lighting fixture 10 may be receivable in a ceiling or a wall 15. For example, lighting fixture 10 may be receivable in a cutout 17 in ceiling or wall 15.

Generally, lighting fixture 10 may include a trim ring or outer peripherally-extending frame 12 having a front surrounding member 20 having a front surrounding surface 21 positionable on ceiling or wall 15 and a rearwardly-extending surrounding member 22 extending rearwardly behind front surrounding member 20. Front surrounding member 20 and rearwardly-extending surrounding member 22 may be opaque or have an opaque covering inhibiting the transmission of light therethrough.

Front surrounding member 20 may define front surrounding surface 21 extending between an outer surrounding peripheral edge 28 and an inner surrounding edge 23. Front surrounding member 20 may define a rear surface 29 (shown in FIGS. 4 and 5). Rearwardly-extending member 22 may define a front surrounding surface 26 extending between inner surrounding edge 23 and a rearward surrounding edge 24. Inner surrounding edge 23 defines a front opening 27 that may be even with the front of the lighting fixture and generally even with the front surface of the ceiling or wall. Rearward surrounding edge 24 of rearwardly-extending surrounding member 22 defines a rear opening 25 offset from front opening 27. Rear opening 25 may be a void, e.g., vacant, open to ambient air, containing nothing, or not filled or covered with a transparent material such as glass or plastic. Front opening 27 may a void, e.g., vacant, open to ambient air, containing nothing, or not filled or covered with a transparent material such as glass or plastic. The space or volume between front opening 27 and rear opening 25 may be a void, e.g., vacant, open to ambient air, containing nothing, or not filled or covered with a transparent material such as glass or plastic. Inner surrounding edge 23 of front surrounding member 20 may be disposed along a first plane, and rearward surrounding edge 24 may be disposed along a second plane. The second plane may be generally aligned with, spaced apart, and parallel to the first plane. In other embodiments, rear opening 25, front opening 27, and/or the space or volume between rear opening 25 and front opening 27 may be filled or covered with a transparent material or translucent material.

Figure 4:
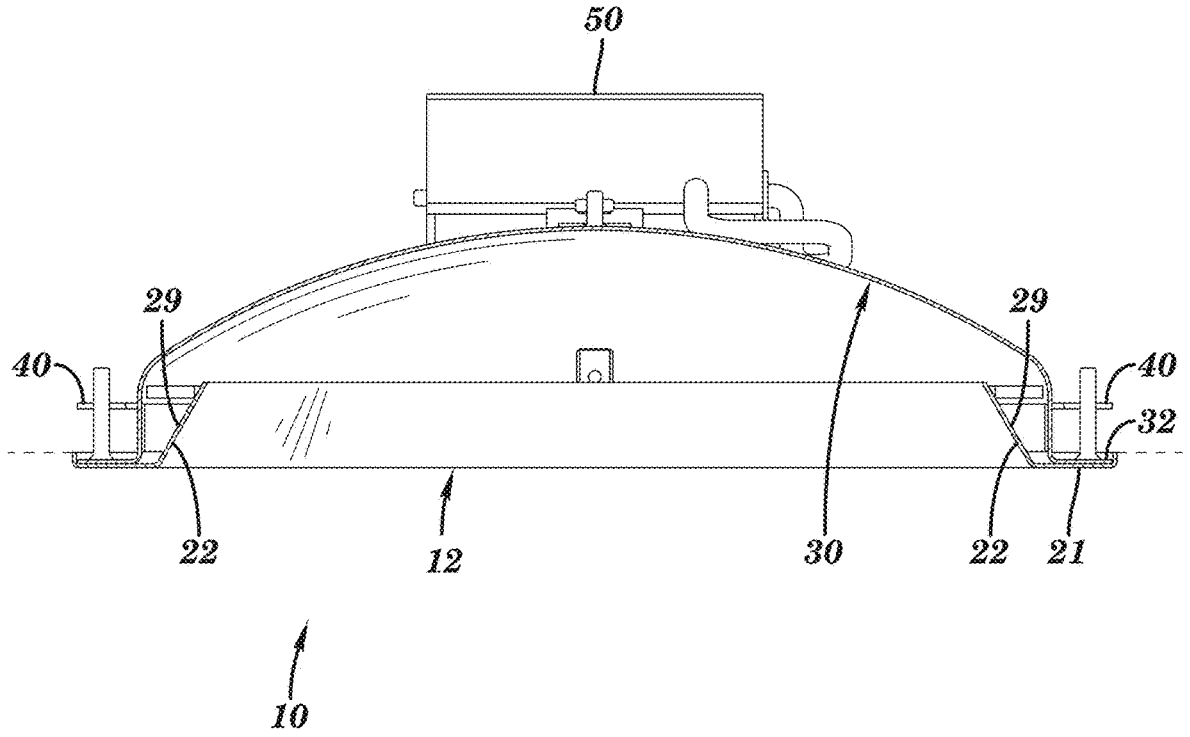
FIG. 4 is a cross-sectional view taken along line 4-4 in FIG. 3.
Figure 5:
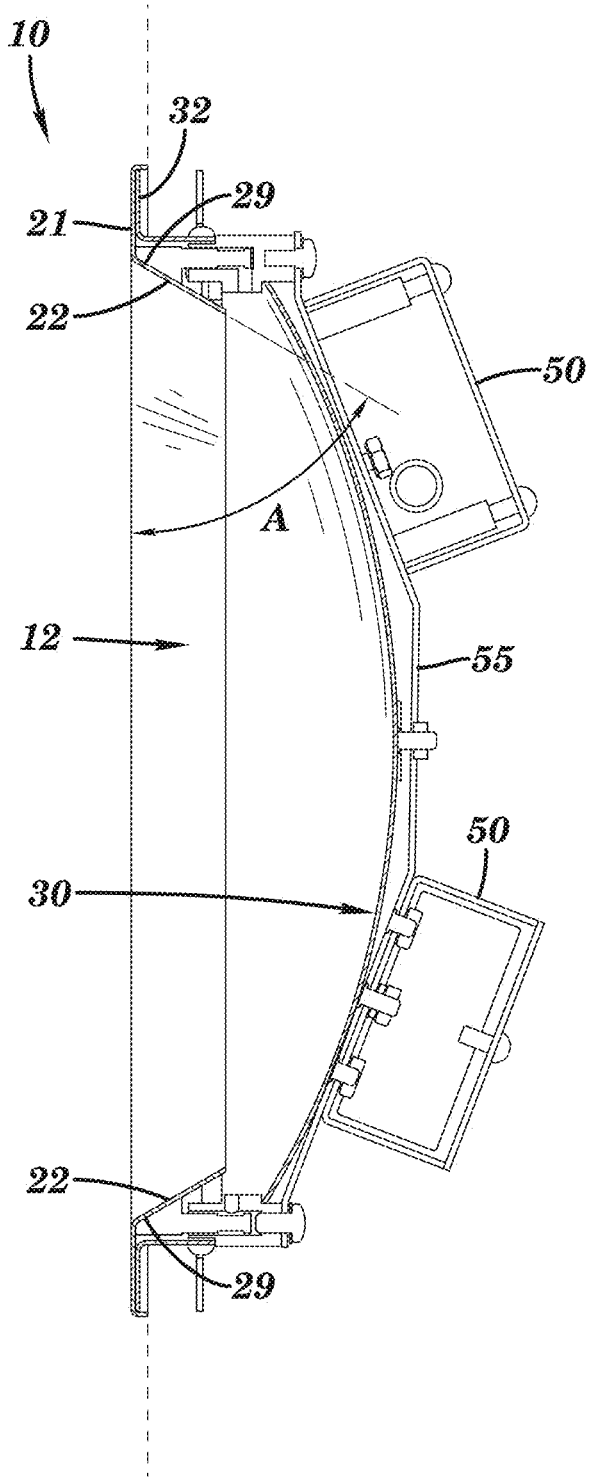
FIG. 5 is a cross-sectional view taken along line 5-5 in FIG. 3.

An interior bowl or center rear member 30 of lighting fixture 10 may include a front facing surface 31 extending behind rear opening 25 and preferably is sized larger to extend behind the entire opening defined by rearward surrounding edge 24 of rearwardly-extending member 22 and extend laterally outwardly from rearward surrounding edge 24 of rearwardly-extending member 22. In some embodiments, rear member 30 may be a front facing surface that is curved as shown in FIGS. 4 and 5 such as a concave surface having an outline or surface curved like the interior of a circle or sphere or bowl. In other embodiments, the rear member may have a front facing surface that may be concave, flat, planar, convex, any other suitable configuration or contour, or combinations of one or more thereof. In some embodiments, the rear member of the lighting fixture may include a front facing surface having a mirror-like reflective front facing surface.

As described in greater detail below, one or more light sources may be positioned behind front surrounding member 20 and/or rearwardly-extending member 22. For example, the light source or light sources such as LEDs (light emitting diodes) may be hidden behind front surrounding member 20 and/or rearwardly-extending member 22 when the lighting fixture is viewed by an observer from the front and offset from the sides. Depending on the positioning of an observer relative to lighting fixture 10, when lighting fixture 10 is ON, i.e., with the one or more lighting sources emitting light, lighting fixture 10 may result in different observable ornamental lighting effects.

Figure 2:
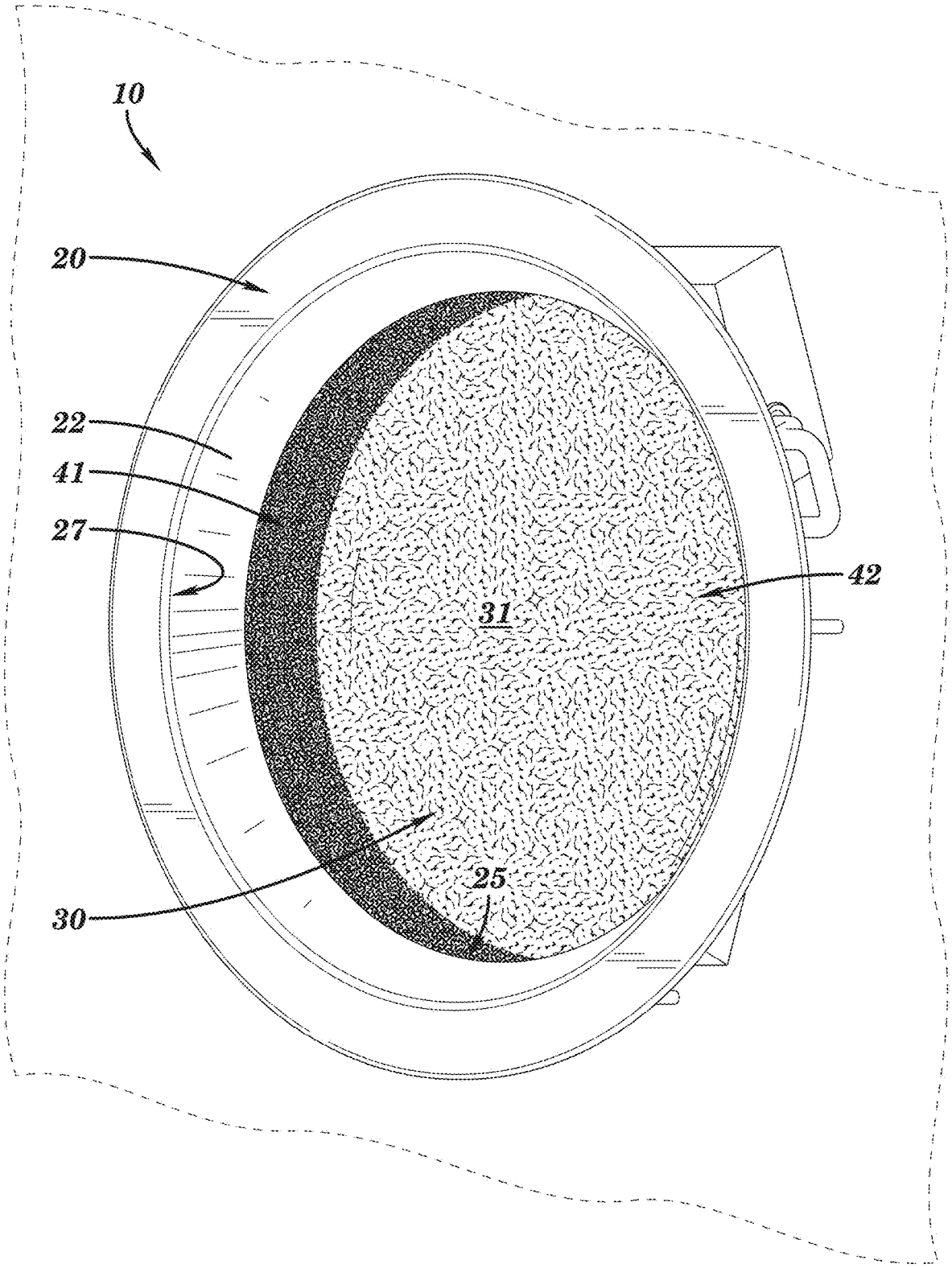
FIG. 2 is a perspective view of the lighting fixture of FIG. 1, in which the light source of the lighting fixture is ON so that the lighting fixture provides illumination or has an illuminated configuration.

As shown in FIG. 2, front facing surface 31 of lighting fixture 10 may be illuminated by light emission from light sources (not shown in FIG. 2) disposed and hidden behind front surrounding member 20 and/or rearwardly-extending member 22 such as along the length of front opening 27, which light emission is reflected off front facing surface 31 of rear member 30 and outward through rear opening 25 of rearwardly-extending member 22 and front opening 27 of front frame 20. For example, for lighting fixture 10 configured as a wall sconce and having a concave front facing surface 31, a reflected light emission portion 41 along front facing surface 31 may appear to be brighter or have a greater ornamental light emission effect or appearance to an observer disposed on a side opposite reflected light emission portion 41 compared to the appearance of the light emission observed by the observer from a center reflected light emission portion and a side reflected light emission portion 42 of front facing surface 31. For example, where front facing surface 31 is a concave surface as shown in FIG. 2, the reflective light emission may result in greater light emission along a portion of the front facing surface 31 disposed adjacent to a portion of rearwardly-extending member 22 compared to the light emission from the center area of rear member 30 and opposite side portion of rear member 30.

Figure 3:
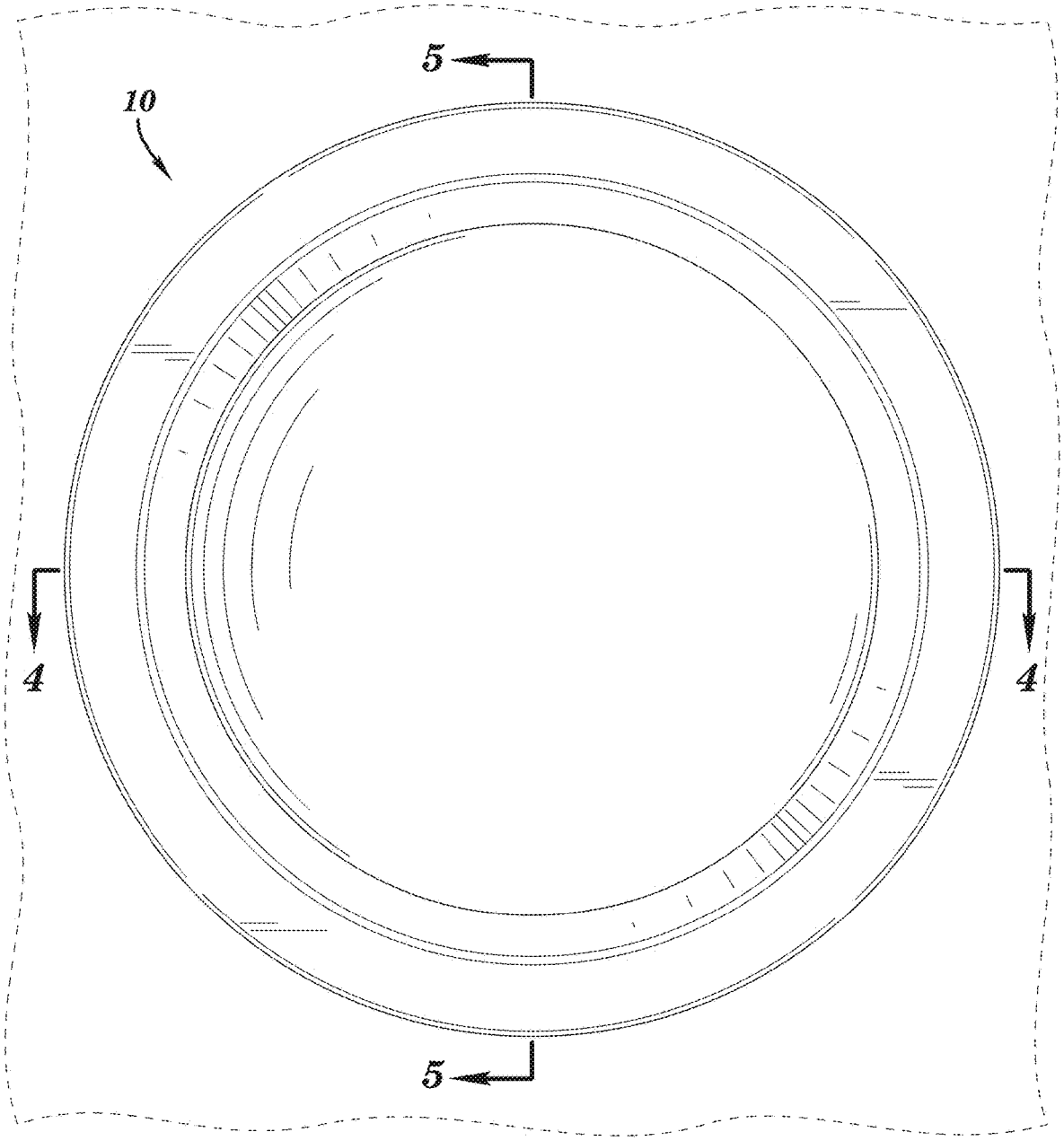
FIG. 3 is a front elevational view of the lighting fixture of FIG. 1.

FIG. 3 illustrates lighting fixture 10 in an unilluminated configuration, i.e., in which the light source (not shown in FIG. 3) of lighting fixture 10 is OFF. Lighting fixture 10 has a generally circular configuration and symmetrical configuration when viewed normal to a ceiling or a wall in which the light fixture is operably attached. As showed in FIGS. 4 and 5, outer frame 12 and rear member 30 may be formed from a suitable thin sheet material such as a suitable thin sheet metal material. Rear member 30 may include a peripheral portion 32 that overlaps a rear surface of front member 21 of the outer frame. As further shown in FIG. 5, rearwardly-extending member 22 may be disposed at an angle A such as at an angle of about 60 degrees relative to the front surface of the front frame or the ceiling or the wall. It will appreciate that a rearwardly-extending member may be disposed normal to the ceiling or wall, at an angle of about 45 degrees, at an angle of about 30 degrees, or at any suitable angle relative to the ceiling or the wall. While the rearwardly-extending surrounding member 22 may be angled inwardly toward the center of the lighting fixture, it will be appreciated that a rearwardly-extending surrounding member may be angled outwardly away from the center of the lighting fixture.

Electrical power may typically be provided to light fixture 10 via an electrical wire or cable (not shown in FIGS. 4 and 5), which cable maybe disposed in the ceiling or wall with such electrical power being conventional 120 or 240 volt AC power from the local electrical grid. In some embodiments, one or more batteries may be located in, on, or adjacent to light fixtures.

Lighting fixture 10 may include one or more power supplies 50 and may be operably attached to lighting fixture 10. Where the light sources are LEDs, the power supplies 50 may be typical power supplies adapted to convert supply voltage, for example, 120 or 240 VAC, to an appropriate voltage for powering the light sources, for example, about 5 to about 50 VDC, or other suitable voltage. Wires (not show in FIGS. 4 and 5 may provide electrical current from the power supplies 50 to the light sources. A bracket 55, best shown in FIGS. 5 and 6, may support power supplies 50 behind rear frame 30 of lighting fixture 10.

Figure 7:
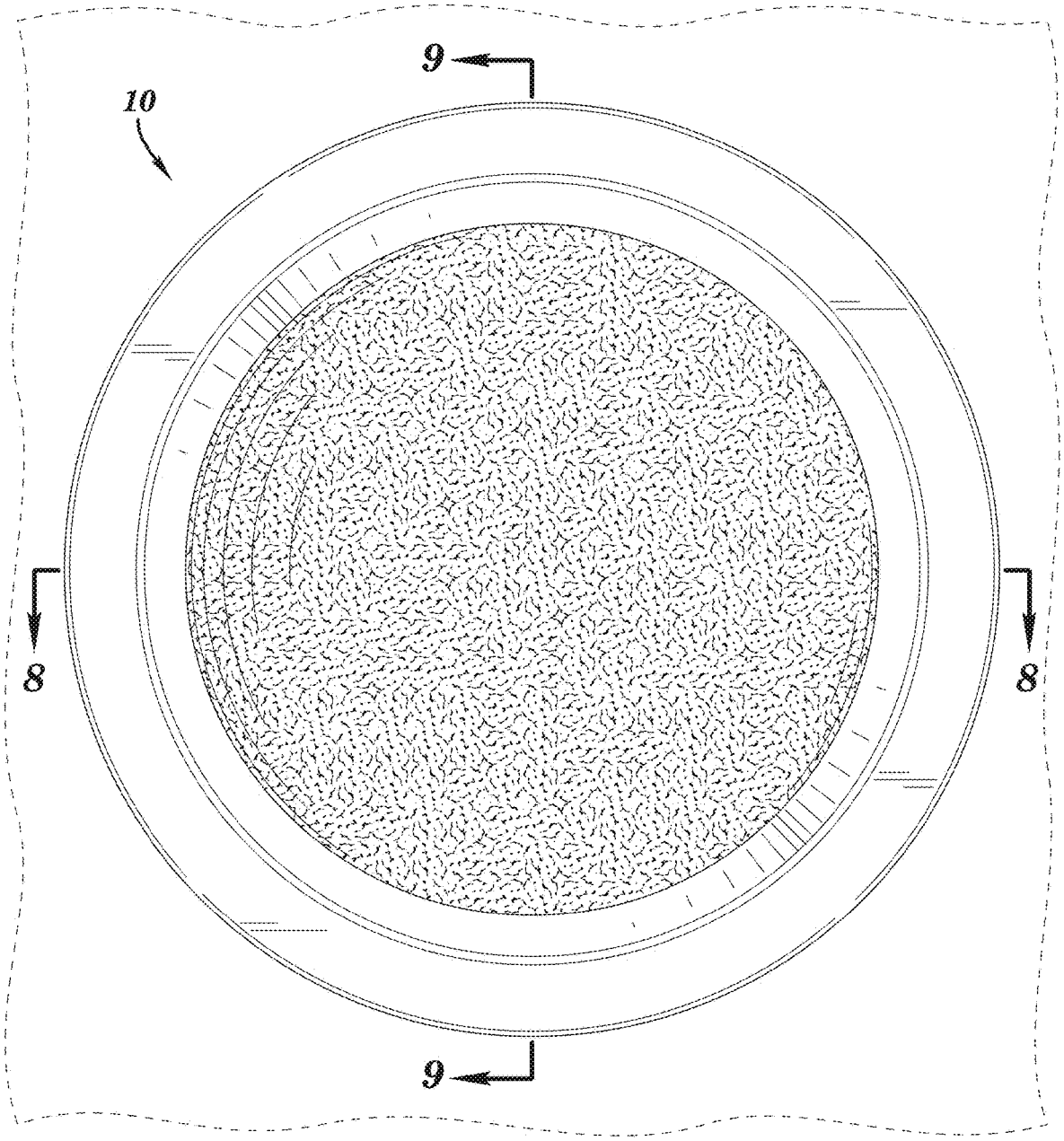
FIG. 7 is a front elevational view of the lighting fixture of FIG. 1, in which the light source of the lighting fixture is ON so that the lighting fixture has an illuminated configuration.

FIG. 7 illustrates lighting fixture 10 in an illuminated configuration, i.e., in which the light source (not shown in FIG. 7) of lighting fixture 10 is ON so that lighting fixture 10 provides illumination or has an illuminated appearance.

Figure 8:
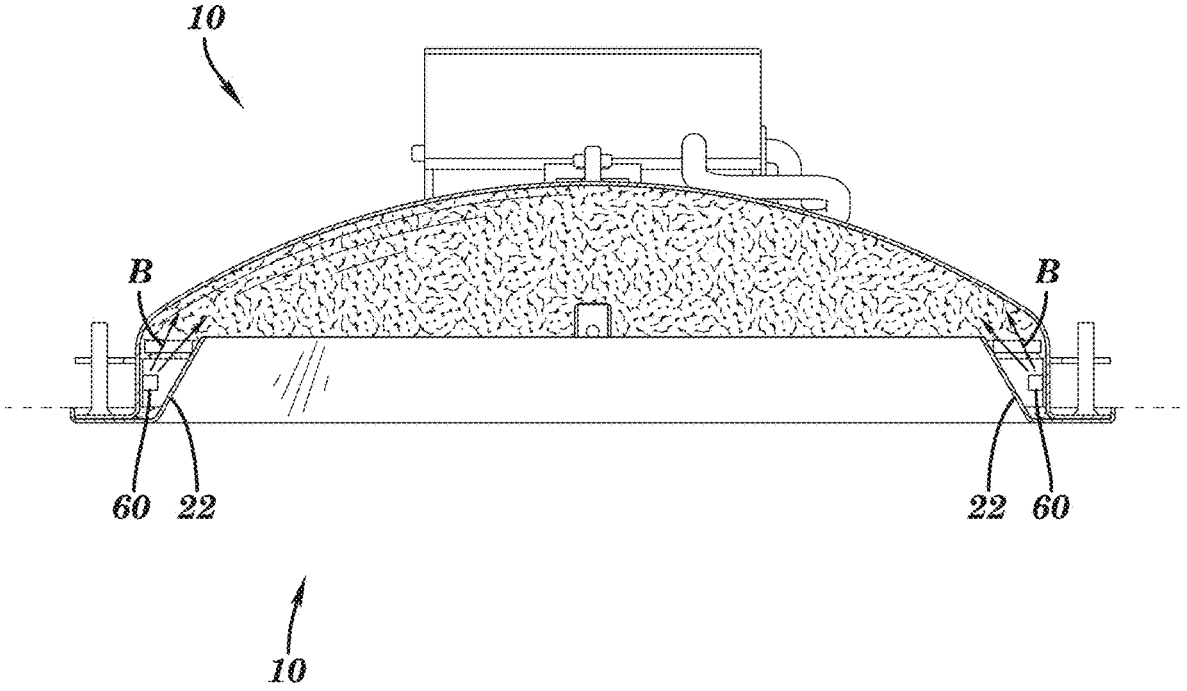
FIG. 8 is a cross-sectional view taken along line 8-8 in FIG. 7.
Figure 9:
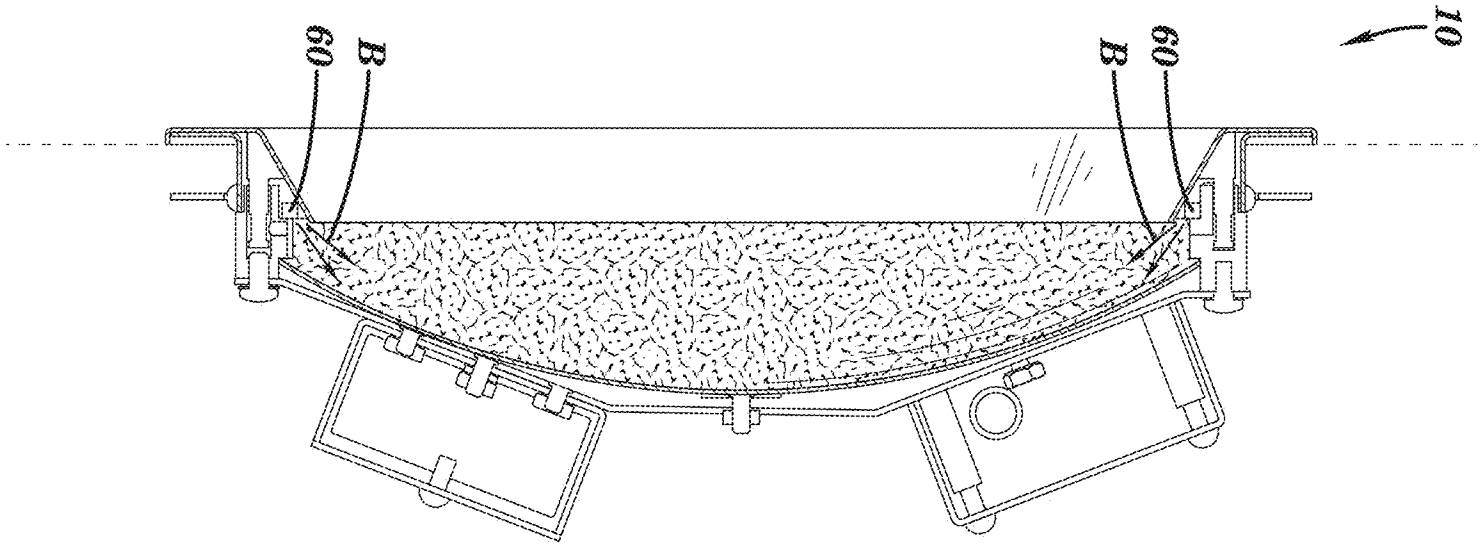
FIG. 9 is a cross-sectional view taken along line 9-9 in FIG. 7.

As shown in FIGS. 8 and 9, a plurality of light sources 60 may be disposed in lighting fixture 10. For example, plurality of light sources 60 may be disposed or spaced around the periphery of lighting fixture 10 such as behind or between an inner hidden surface of rearwardly-extending surrounding member 22 (FIG. 8) and/or a peripherally surrounding inner hidden surface of rear member 30. Light sources 60 may be strip-mounted LEDs (light emitting diodes). It will appreciated that other suitable LEDs may be employed. In other embodiments, different types of light sources may be employed, for example, incandescent bulbs, fluorescent bulbs, etc.

The light source or light sources may be hidden behind the rearwardly-extending inner portion 22 (FIG. 8) when the lighting fixture is viewed from the front and from the sides. Light sources 60 may direct light in any desired direction. In some embodiments, light sources 60 may direct light in a generally axial direction as indicated by arrows B in FIGS. 8 and 9. In other embodiments, the light emission may radiate outwardly for the light source or sources.

Figure 10:
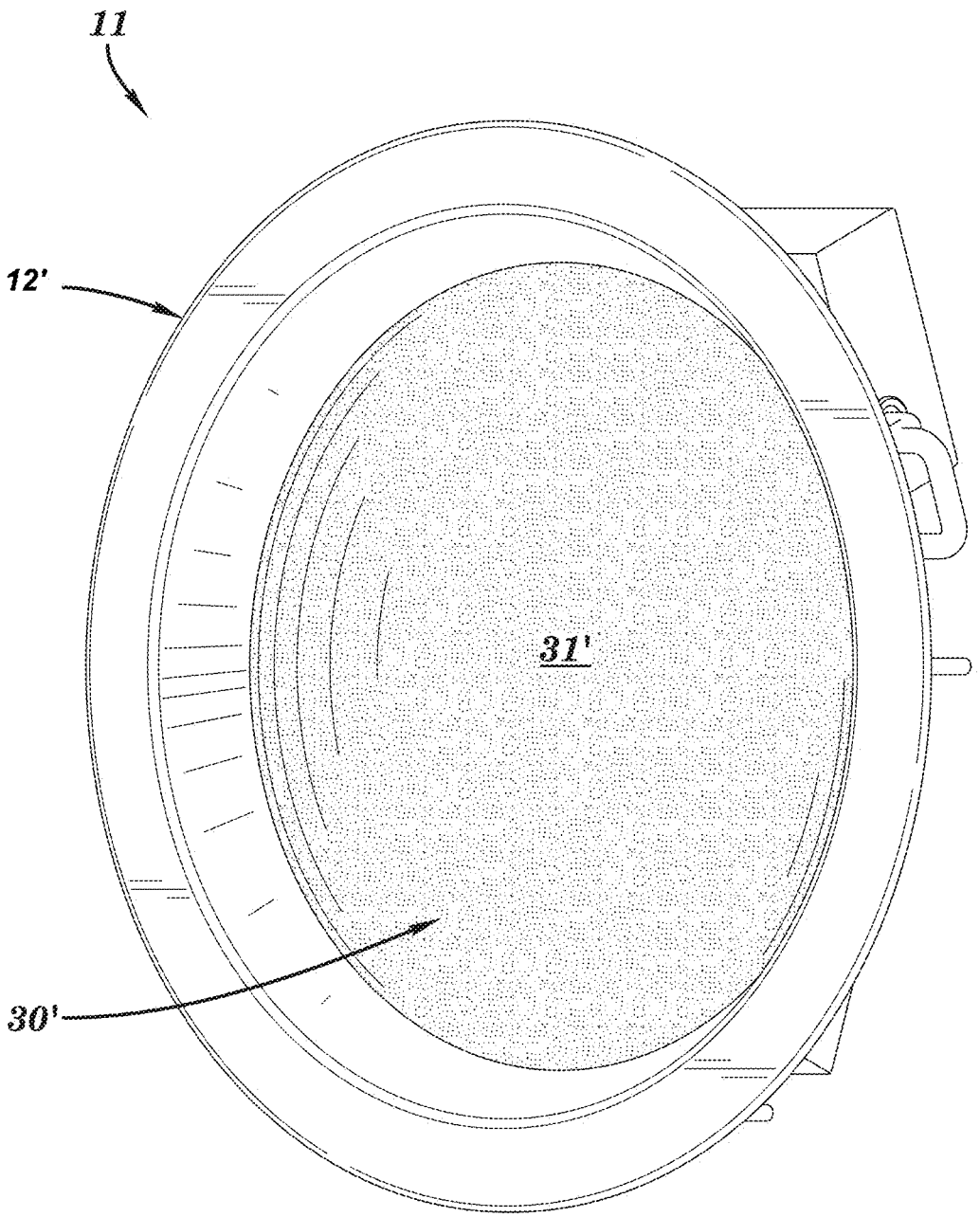
FIG. 10 is a perspective view of a lighting fixture according to an embodiment of the present disclosure, in which one or more portions of the lighting fixture have contrasting appearance, and wherein the light source of the fixture is OFF so that the lighting fixture has an unilluminated configuration.

FIG. 10 illustrates a lighting fixture 11 according to an embodiment of the present disclosure illustrated in a non-illuminated or unilluminated configuration. Lighting fixture 11 is essentially the same as lighting fixture 10 (FIG. 1) with the exception that the outer surrounding frame 12' and the front facing surface 31' of rear member 30' may have contrasting appearances, different surface finishes, textures, or different colors. For example, front facing surface 31' of rear member 30' may have a first color and outer surrounding frame 12' may have a second color different from the first color. In some embodiments, the outer surrounding frame may be white or black, and the rear frame may be a white or yellow gold leaf. In other embodiments, the front facing surface of rear member may have a mirror-like reflective surface, and the outer surrounding frame may have a non-reflective or flat surface finish. Other finish combinations may include the outer surrounding frame being white primer and paired with the front facing surface of rear member being matte white or sterling gold. Still other finish combinations may include the outer surrounding frame being blacked steel and paired with the front facing surface of rear member being 22 k yellow gold, 12 k white gold, or aluminum leaf.

Figure 11:
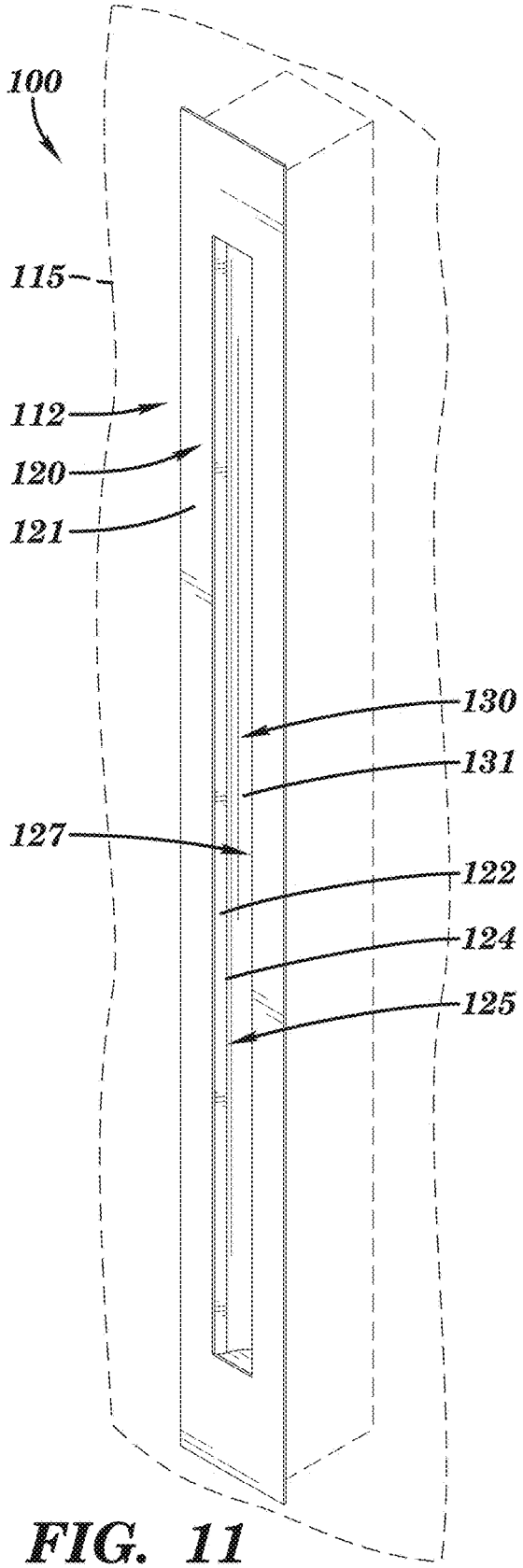
FIG. 11 is a perspective view of a lighting fixture according to an embodiment of the present disclosure, in which a light source of the lighting fixture is OFF so that the lighting fixture has an unilluminated configuration.

FIG. 11 illustrates a lighting fixture 100 according to an embodiment of the present disclosure illustrated in a non-illuminated or unilluminated configuration, i.e., in which a light source (not shown in FIG. 11) of lighting fixture 100 is OFF. Lighting fixture 100 may be receivable in a wall 115. For example, lighting fixture 100 may be receivable in a cutout in wall 115.

Generally, lighting fixture 100 includes a peripherally-extending frame 112, which includes an elongated front member 120 and a pair of rearwardly-extending members 122 (only one side being shown in FIG. 11).

Elongated front member 120 may include a front surface 121 positionable generally on or generally evenly with the wall 115. Front member 120 may surround an elongated front opening 127. The pair of rearwardly-extending members 122 (only one side being shown in FIG. 11) extends rearwardly behind opposite elongated sides of elongated front opening 127. Rearward elongated edges 124 of rearwardly-extending members 122 define a rear opening 125 (best shown in FIG. 15). Front surrounding member 120 and rearwardly-extending member 122 may be opaque or have an opaque covering inhibiting the transmission of light therethrough. Front surrounding member 120 and front opening 127 may be disposed along a first plane. In some embodiments, front opening 127 may be a void, e.g., vacant, open to ambient air, containing nothing, or not filled or covered with a transparent material such as glass or plastic. Rear opening 125 may be a void, e.g., vacant, open to ambient air, containing nothing, or not filled or covered with a transparent material such as glass or plastic. The space or volume between front opening 127 and rear opening 125 may be a void, e.g., vacant, open to ambient air, containing nothing, or not filled or covered with a transparent material such as glass or plastic. In other embodiments, front opening 127 may be filled or covered with a transparent material or translucent material. Rearward surrounding edge 124 may be disposed along a second plane. The second plane may be generally aligned with, spaced apart and parallel to the first plane. In other embodiments, rear opening 125, front opening 127, and/or the space or volume between rear opening 125 and front opening 127 may be filled or covered with a transparent material or translucent material.

Figure 15:
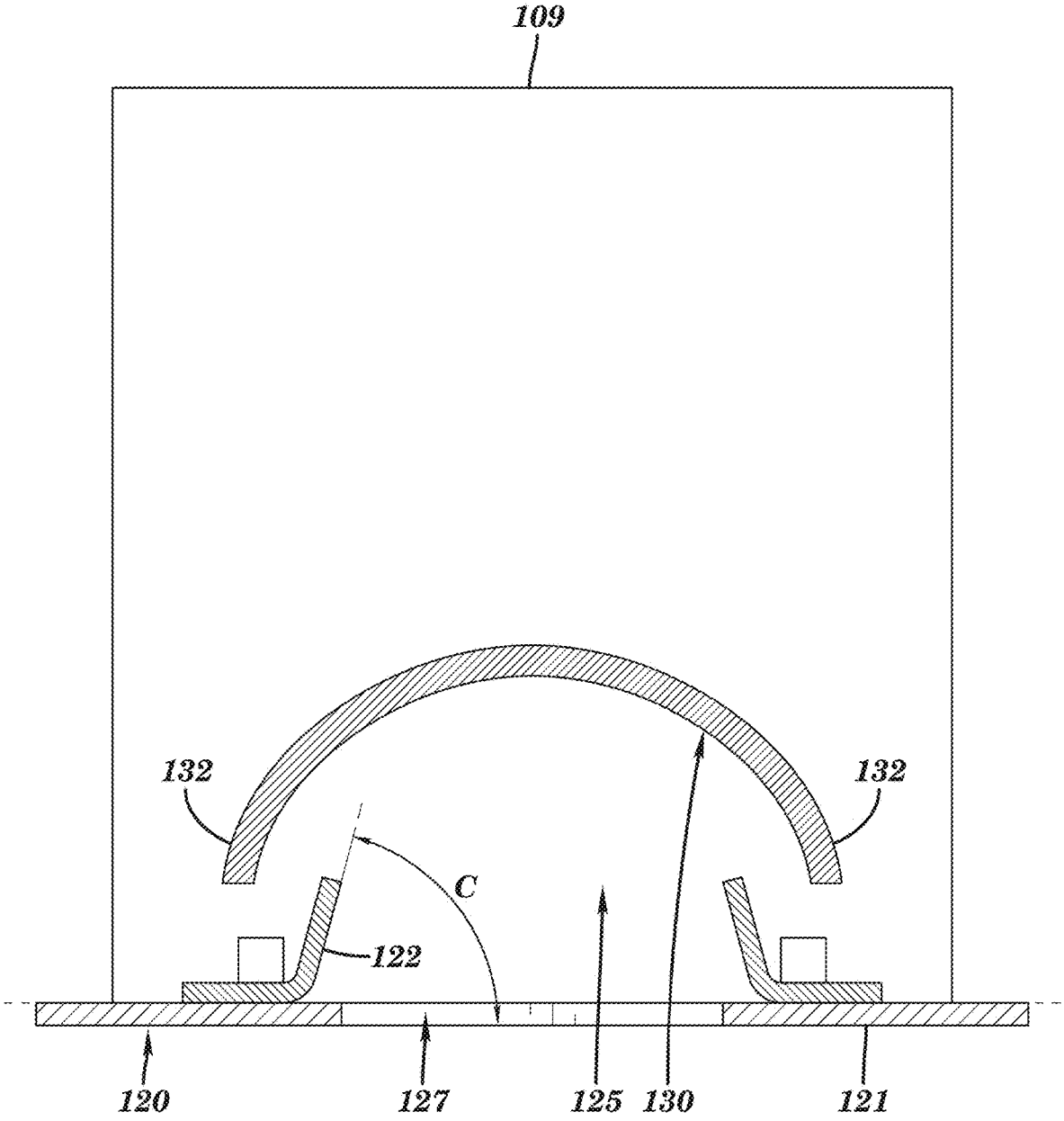
FIG. 15 is a cross-sectional view taken along line 15-15 in FIG. 13.

A rear member 130 having a front facing surface 131 extends behind front opening 127 and rear opening 125 and preferably is sized larger to extend behind the entire rear opening 125 defined by rearward elongated edges 124 of rearwardly-extending members 122 and extend laterally outward from rearward elongated edges 124 of rearwardly-extending member 122 as best shown in FIG. 15. In some embodiments, the rear member may have a front facing surface that is curved as shown in FIG. 11 (and as best shown in FIG. 15) such as a concave surface having an outline or surface curved like the interior of a channel. In other embodiments, the rear member may have a front facing surface that may be concave, flat, planar, convex, or any other suitable configuration or contour, or combinations of one or more thereof. In some embodiments, rear member 130 of lighting fixture 100 may include a front facing surface having a mirror-like reflective front facing surface.

One or more a light source may be positioned behind front member 120 and rearwardly-extending member 122 as described in greater detail below. For example, the light source or light sources such as LEDs (light emitting diodes) may be hidden behind front member 120 (FIG. 11) and/or rearwardly-extending members 122 when the lighting fixture is viewed by an observer from the front and offset from the sides. Depending on the positioning of an observer relative to lighting fixture 100, when lighting fixture 100 is ON, i.e., with the one or more lighting sources emitting light, lighting fixture 100 may result in lighting fixture 100 having different observable ornamental lighting effects.

Figure 12:
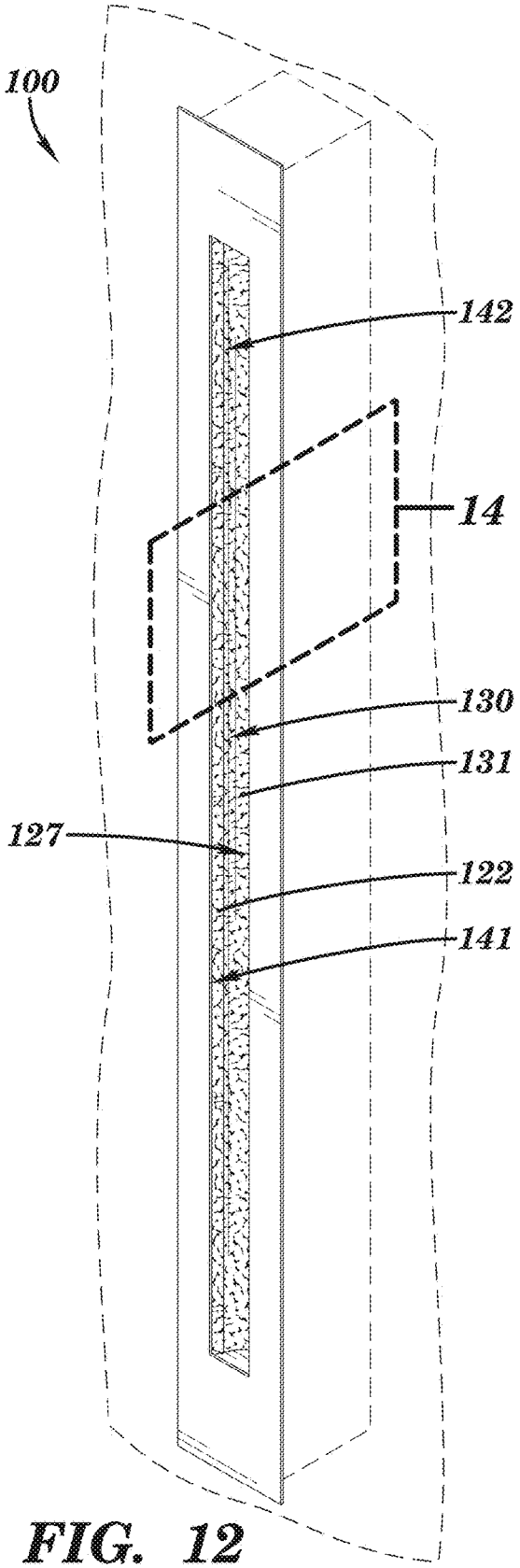
FIG. 12 is a perspective view of the lighting fixture of FIG. 11, in which the light source of the lighting fixture is ON so that the lighting fixture provides illumination or has an illuminated configuration.

As shown in FIG. 12, front facing surface 131 of lighting fixture 100 may be illuminated by light emissions from light sources (not shown in FIG. 12) disposed and hidden behind front member 120 and rearwardly-extending members 122 such as along the length of the opening 127, which light emission is reflected off front facing surface 131 of rear member 130 and outward through rear opening 125 (FIGS. 11 and 15) and front opening 127 of lighting fixture 100. For example, for lighting fixture 100 configured as a wall sconce and having a curved front facing surface 131, a reflected light emission portion 141 along front facing surface 131 may appear to be brighter or have a greater ornamental light emission effect or appearance to an observer disposed on the opposite side compared to the appearance of the light emission observed by the observer from a center reflected light emission portion of front facing surface 131.

Figure 13:
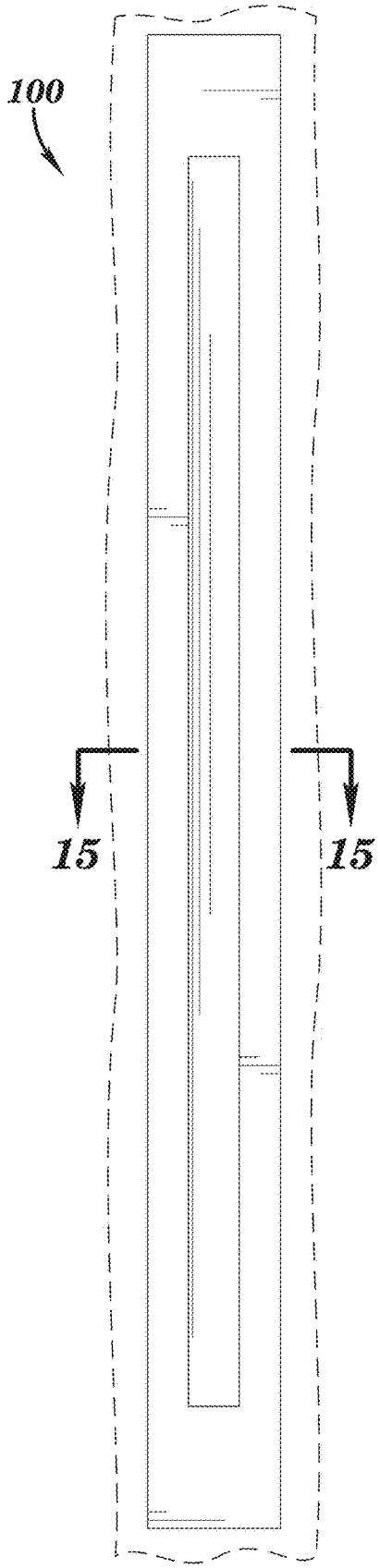
FIG. 13 is a front elevational view of the lighting fixture of FIG. 11.
Figure 14:
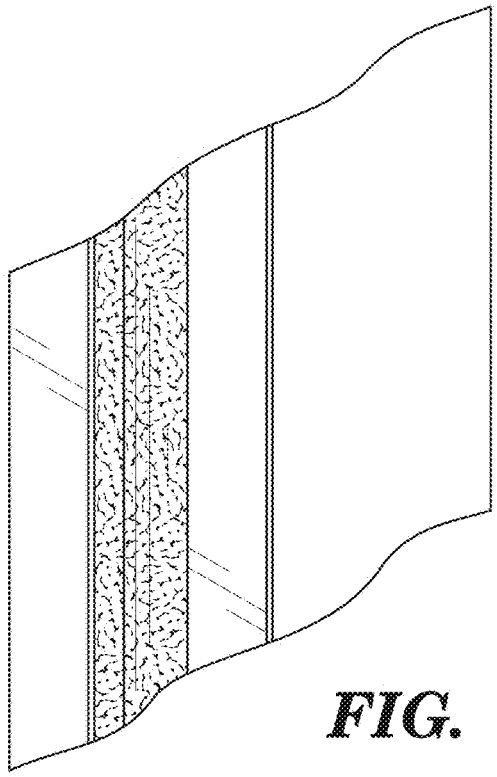
FIG. 14 is an enlarged perspective view of Detail 14 of FIG. 12.

FIG. 13 illustrates lighting fixture 100 in an unilluminated configuration, i.e., in which the light source (not shown in FIG. 13) of lighting fixture 100 is OFF. Lighting fixture 100 has a generally elongated rectangular configuration and elongated symmetrical configuration when viewed normal to the wall. As showed in FIG. 15, front member 120 and rear member 130 may be formed from a suitable thin sheet material such as a suitable thin sheet metal material. Rear member 130 may include peripheral edge portions 132 that overlaps a rear surface of rearwardly-extending member 122. As further shown in FIG. 15, rearwardly-extending member 122 may be disposed at an angle C such as at an angle of about 80 degrees relative to front surface 121 of front member 120 or the surface of the wall. It will appreciate that a rearwardly-extending member may be disposed normal to the wall or at any suitable angle, such as at 30 degrees, 45 degrees, 60 degrees, or at any suitable angle relative to the wall. While the rearwardly-extending member 122 may be angled inwardly toward the center of the lighting fixture, it will be appreciated that a rearwardly-extending member may be angled outwardly away from the center of the lighting fixture.

Electrical power may typically be provided to light fixture 100 via an electrical wire or cable (not shown in FIG. 15), which cable maybe disposed in the wall with such electrical power being conventional 120 or 240 volt AC power from the local electrical grid. In some embodiments, one or more batteries may be located in, on, or adjacent to light fixtures.

Lighting fixture 100 may include one or more power supplies (not shown in FIG. 15) and may be operably attached to lighting fixture 100. Where the light sources are LEDs, the power supplies may be typical power supplies adapted to convert supply voltage, for example, 120 or 240 VAC, to an appropriate voltage for powering the light sources, for example, about 5 to about 50 VDC, or other suitable voltage. Wires (not show in FIG. 15 may provide electrical current from the power supplies to the light sources. A bracket (not shown) may support the power supply from a housing 109 disposed behind rear frame 130 of lighting fixture 100 or the power supply may be directly attached to housing 109. Housing 109 may be operably attached to front frame with bolts, screws, magnets, or other suitable attachment means.

Figure 16:
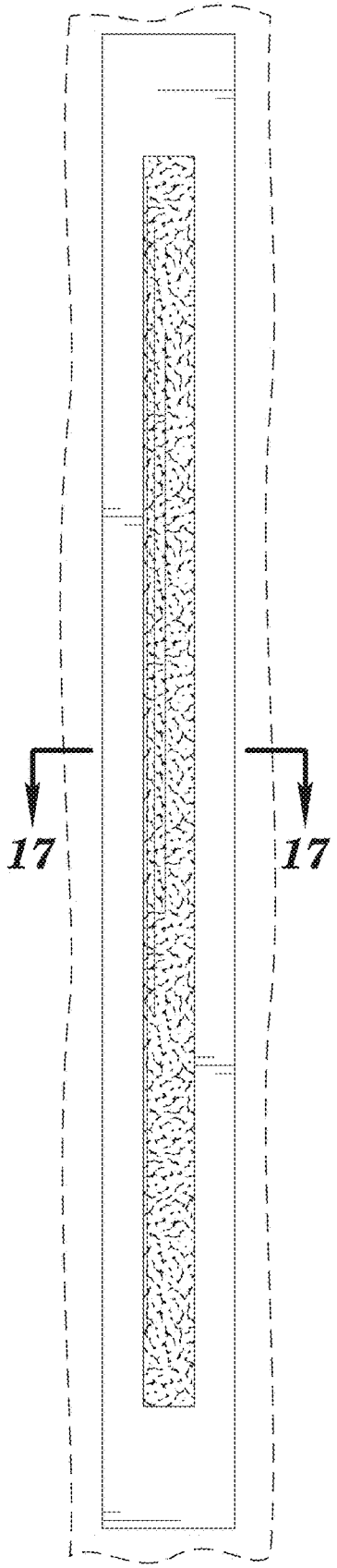
FIG. 16 is a front elevational view of the lighting fixture of FIG. 11, in which the light source of the lighting fixture is ON so that the lighting fixture has an illuminated configuration.

FIG. 16 illustrates lighting fixture 100 in an illuminated configuration, i.e., in which the light source (not shown in FIG. 16) of lighting fixture 100 is ON so that lighting fixture 100 provides illumination.

Figure 17:
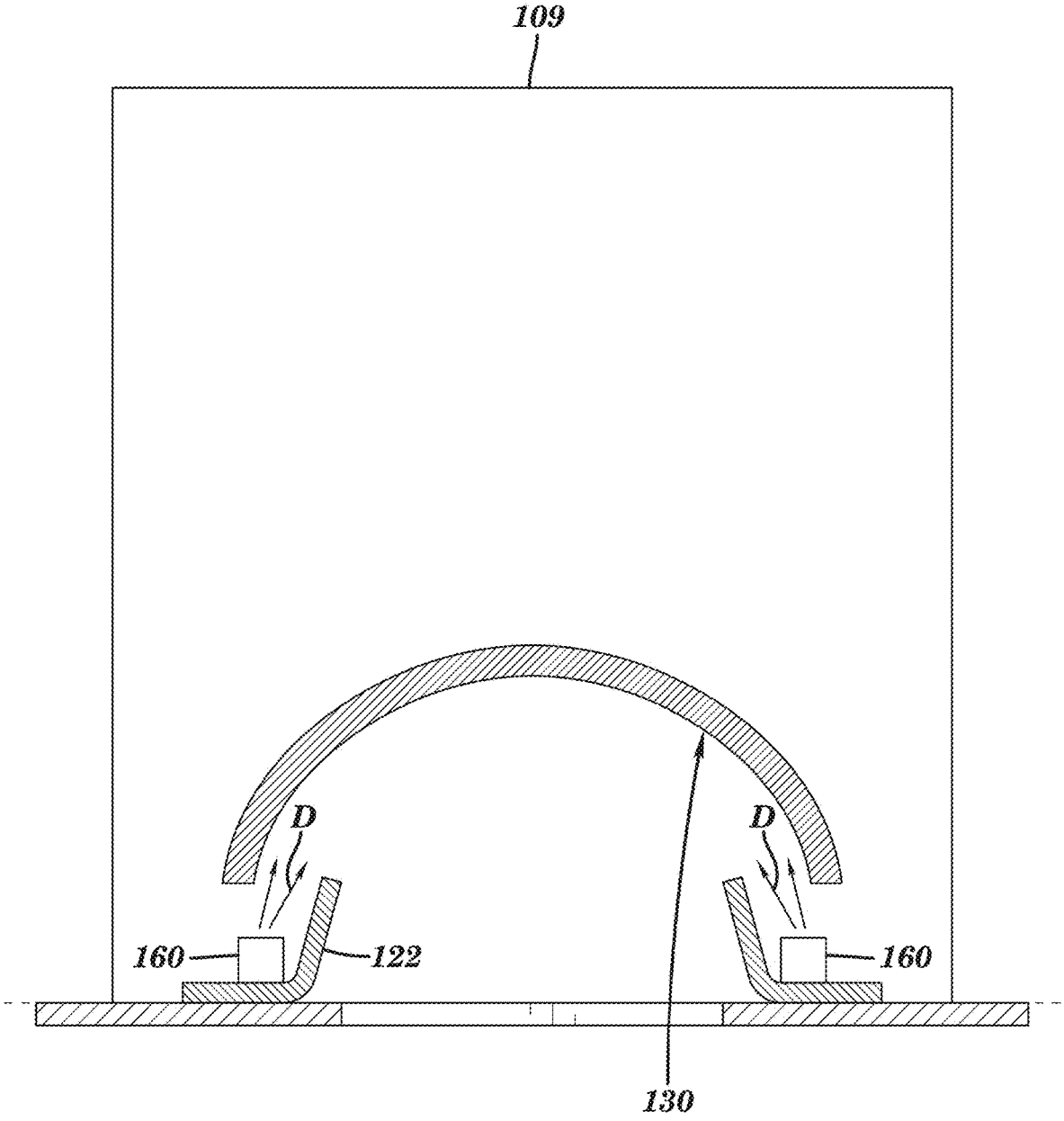
FIG. 17 is a cross-sectional view taken along line 17-17 in FIG. 16.

As shown in FIG. 17, a plurality of light sources 160 may be disposed in lighting fixture 100. For example, plurality of light sources 160 may be disposed or spaced along the vertical sides of lighting fixture 100 such as between an inner hidden surface of rearwardly-extending member 122 and a peripheral inner hidden surface of rear frame 130. Light sources 160 may be strip-mounted LEDs. It will appreciated that other suitable LEDs may be employed. In other embodiments, different types of light sources may be employed, for example, incandescent bulbs, fluorescent bulbs, etc. Light sources 160 may direct light in any desired direction. In some embodiments, light sources 160 may direct light in a generally an axial direction as illustrated in FIG. 17 as indicated by arrows D in FIG. 17. In other embodiments, the light emission may radiate outwardly for the light source or sources.

Figure 18:
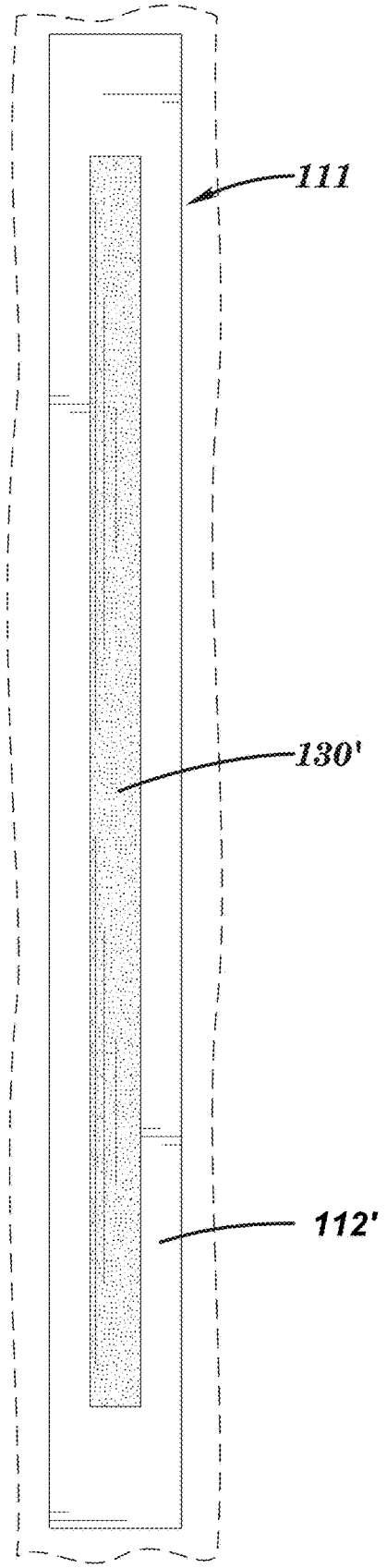
FIG. 18 is a front elevational view of a lighting fixture according to an embodiment of the present disclosure, in which one or more portions of the lighting fixture have contrasting appearance, and wherein the light source of the fixture is OFF so that the lighting fixture has an unilluminated configuration.

FIG. 18 illustrates a lighting fixture 111 according to an embodiment of the present disclosure illustrated in a non-illuminated or unilluminated configuration. Lighting fixture 111 is essentially the same as lighting fixture 100 (FIG. 11) with the exception that the outer peripheral portion and the front facing surface of the rear frame may have contrasting appearance, different surface finishes, textures, or different colors. For example, a rear frame 130' may have a first color and outer peripheral portion 112' may have a second color different from the first color. In some embodiments, the outer peripheral portion may be white or black, and the rear frame may be a white or yellow gold leaf. In other embodiments, the rear frame may have a mirror-like reflective surface, and the outer peripheral portion may be a non-reflective or flat surface finish. Other finish combinations may include the outer peripheral portion being white primer and paired with the rear frame being matte white or sterling gold. Still other finish combinations may include the outer peripheral portion being blacked steel and paired with the rear frame being 22 k yellow gold, 12 k white gold, or aluminum leaf.

Figure 6:
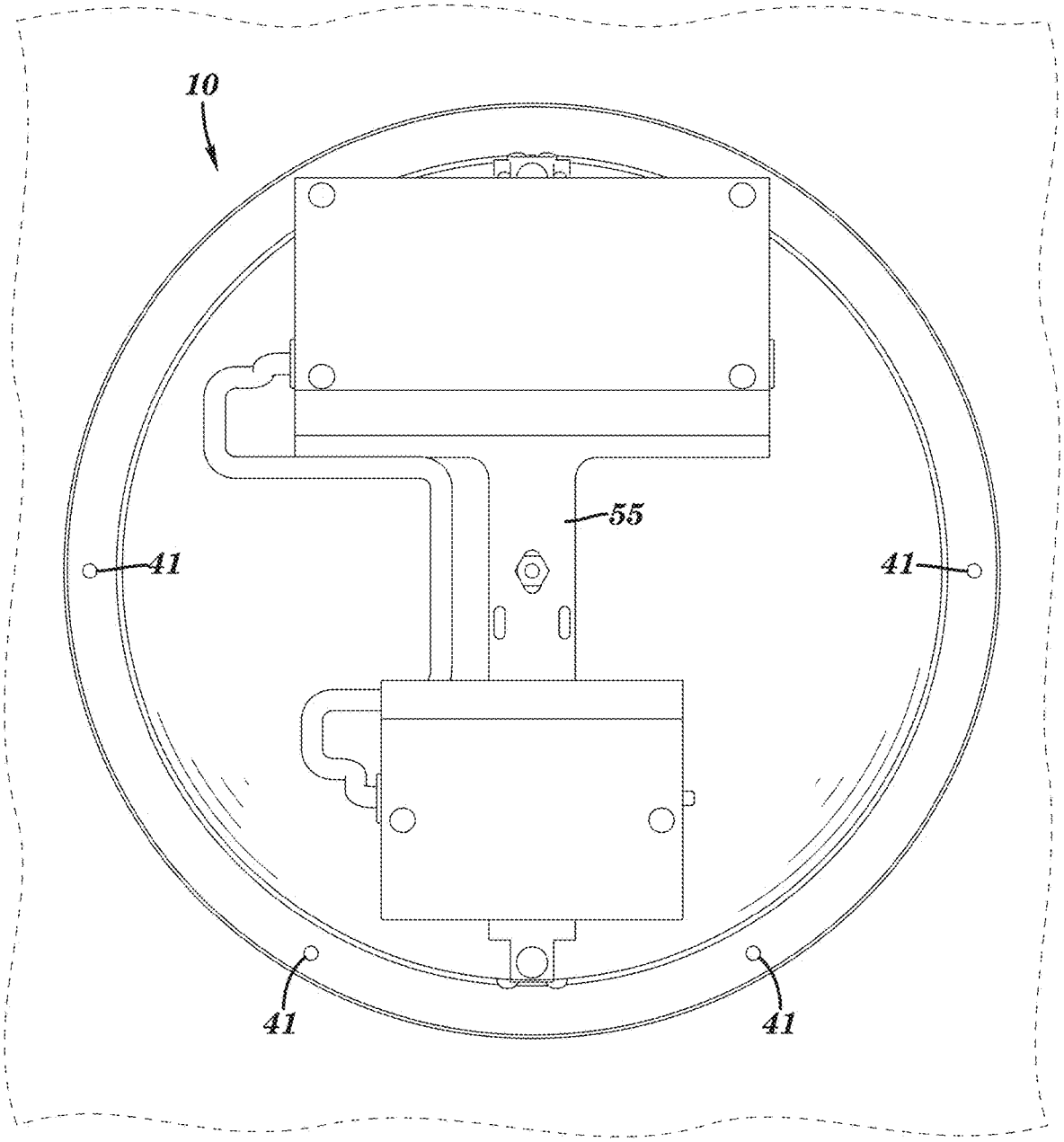
FIG. 6 is a rear elevational view of the lighting fixture of FIG. 1.

In some embodiments, the round lighting fixtures of the present disclosure may be installed by being recessed into a wall or ceiling. Such installation steps may include, cutting an opening in the sheet rock of a wall or a ceiling, which may include a template to allow the installer to cut the appropriate hole diameter into the wall or the ceiling, marking bracket holes (corresponding to holes 41 as shown in FIG. 6) and drill for attachment to adjustable brackets (brackets 40 as shown in FIG. 4), operably electrically connecting the lighting fixture to an electrical supply, installing the adjustable brackets by clamping onto the sheetrock at the mounting holes to secure the lighting fixture without the front frame, and operably attaching the front frame.

In some embodiments, the elongated lighting fixtures of the present disclosure may be installed by being recessed into a wall. Such installation steps may include cutting an opening in the sheet rock of a wall, which may include suitable wood blocking being installed in the wall, operably electrically connecting the lighting fixture to an electrical supply by passing one or more cables through an opening in the housing, attaching the housing to the wood blocking with screws, and operably attaching the front frame.

While the elongated lighting fixtures are illustrated installed in a wall in a vertically disposed orientation, it will be appreciated that the elongated lighting fixtures may be installed in a wall in a horizontally disposed orientation. The elongated lighting fixtures may be operably configured and operably securely installed in a recess in a ceiling.

Figure 19:
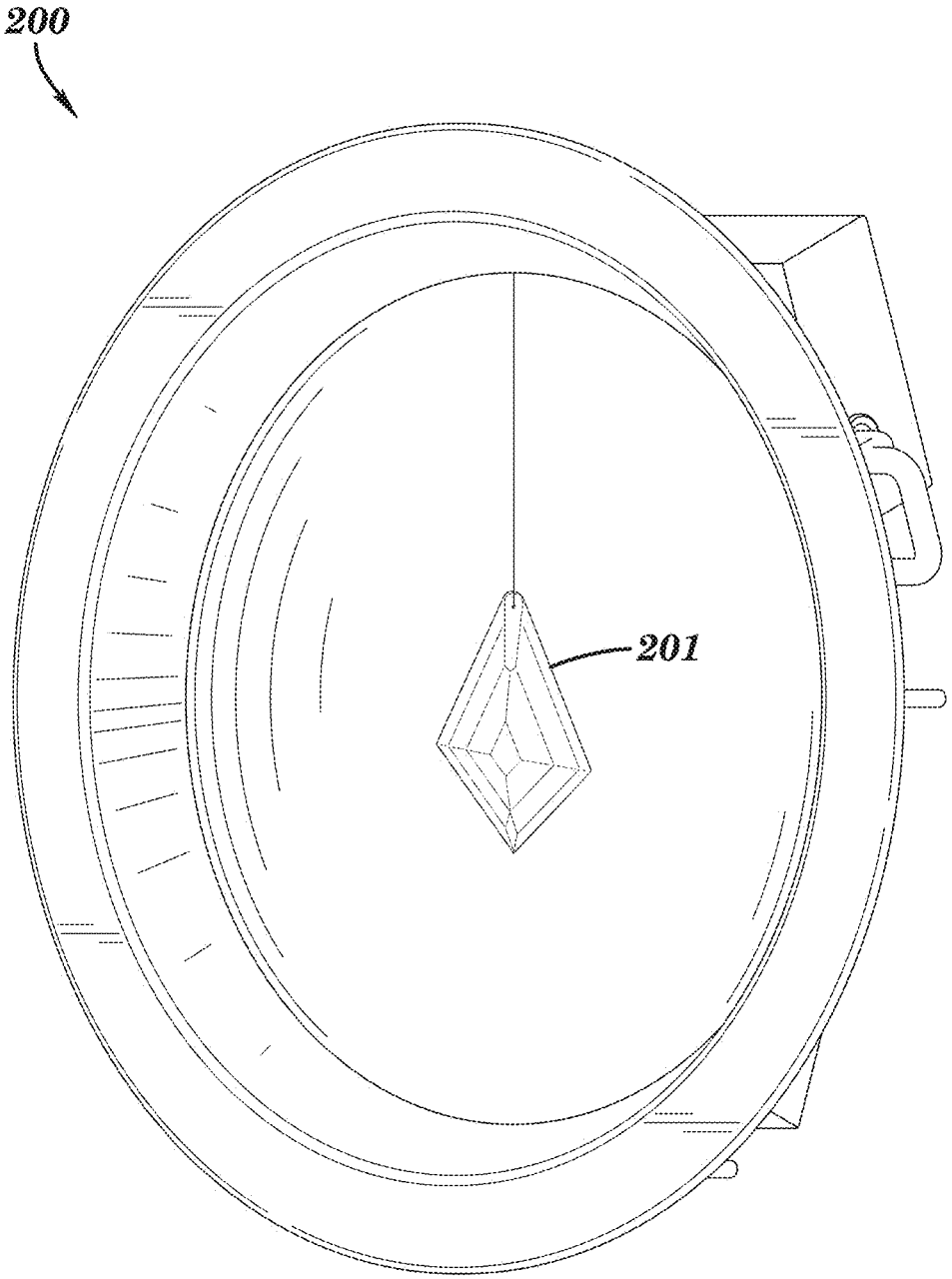
FIG. 19 is a perspective view of a lighting fixture according to an embodiment of the present disclosure, and in which a light source of the lighting fixture is OFF so that the lighting fixture has an unilluminated configuration.

FIG. 19 is another embodiment of a lighting fixture 200 according to an embodiment of the present disclosure illustrated in a non-illuminated or unilluminated configuration. Lighting fixture 200 is essentially the same as lighting fixture 10 (FIG. 1) with the exception of including an object 201 such as a gemstone, jewelry, a sculpture, or any other object or objects in combination with the lighting fixture. For example, the object may be disposed in front of the front opening in the lighting fixture, between the front opening and the rear opening, behind the rear opening and in the cavity defined by the lighting fixture which may be illuminated as described above. It will be appreciated, the objects may be disposed and illuminated and observable in any of the various lighting fixtures described above.

A generally round or circular lighting fixtures of the present disclosure may be about 11 inches in diameter and have a depth of about 4 inches. The light source may be LEDS having about 21 total watts, producing about 1,050 fixture lumens, standard 3000K/90+ CRI, operable using universal 120 v-277 v. The fixture can be dimmed using 0-10 v low voltage dimming controls and wiring. In other embodiments, a generally round or circular lighting fixtures of the present disclosure may be about 15 inches in diameter and have a depth of about 4 inches. The light source may be LEDS having about 24 total watts, producing about 1,250 fixture lumens, standard 3000K/90+ CRI, operable using universal 120 v-277 v. The fixture can be dimmed using 0-10 v low voltage dimming controls and wiring. It will be appreciate that generally round or circular lighting fixtures may have other suitable diameters, depths, and operating particulars.

An elongated lighting fixtures of the present disclosure may be about 37 inches long and about 3 to 4 inches wide, and about 3 inches in depth. The light source may be LEDS having about 27 total watts, producing about 900 fixture lumens, standard 2700K/90+ CRI, operable using universal 120 v-277 v. The fixture can be dimmed using 0-10 v low voltage dimming controls and wiring.

In other embodiments, the front facing surface of the rear frame and the front member of the lighting fixtures may have any surface finishes. Surface finishes may include polished metals, satin metals, gossamer metal, antiqued metal, paint, leather, hand-applied leaf, powder coat, wood, or any other surface finish. For example, in some embodiments, the front member may be black and the front facing surface of the rear frame may be gold leaf.

Further lighting fixtures according to the present disclosure may have other shapes and configurations such as square, oval, triangular, hexagonal, octagonal, polygonal, as well as irregular shapes. The openings may correspond in shape to the outer front frame or front member, or openings may not correspond or be different in shape to the outer front frame or front member. In other embodiments, the rear frame of the lighting fixture may have a front facing surface having a mirror-like reflective front facing surface, a non-mirror-like front facing surface, a textured surface, other type surface, or combinations thereof. In some embodiments, the peripherally-extending frame may include a flat member surrounding an opening and not including a rearwardly-extending member. A light source may be disposed outward from the opening so that the light source is not observable by an observer, i.e., operably obscured by portions of the flat member disposed adjacent to the opening.

In other embodiments, lighting fixtures of the present disclosure need not be disposed on a recess of a wall or a ceiling, but instead may be operable supported from a surface of a wall or a ceiling such as attached thereto. In other embodiments, lighting fixtures of the present disclosure may be spaced apart and suspended from a wall or a ceiling. In some embodiments, the peripherally-extending frame, the front member, and/or the rearwardly-extending member may be assembled from a plurality of components.

Figure 20:
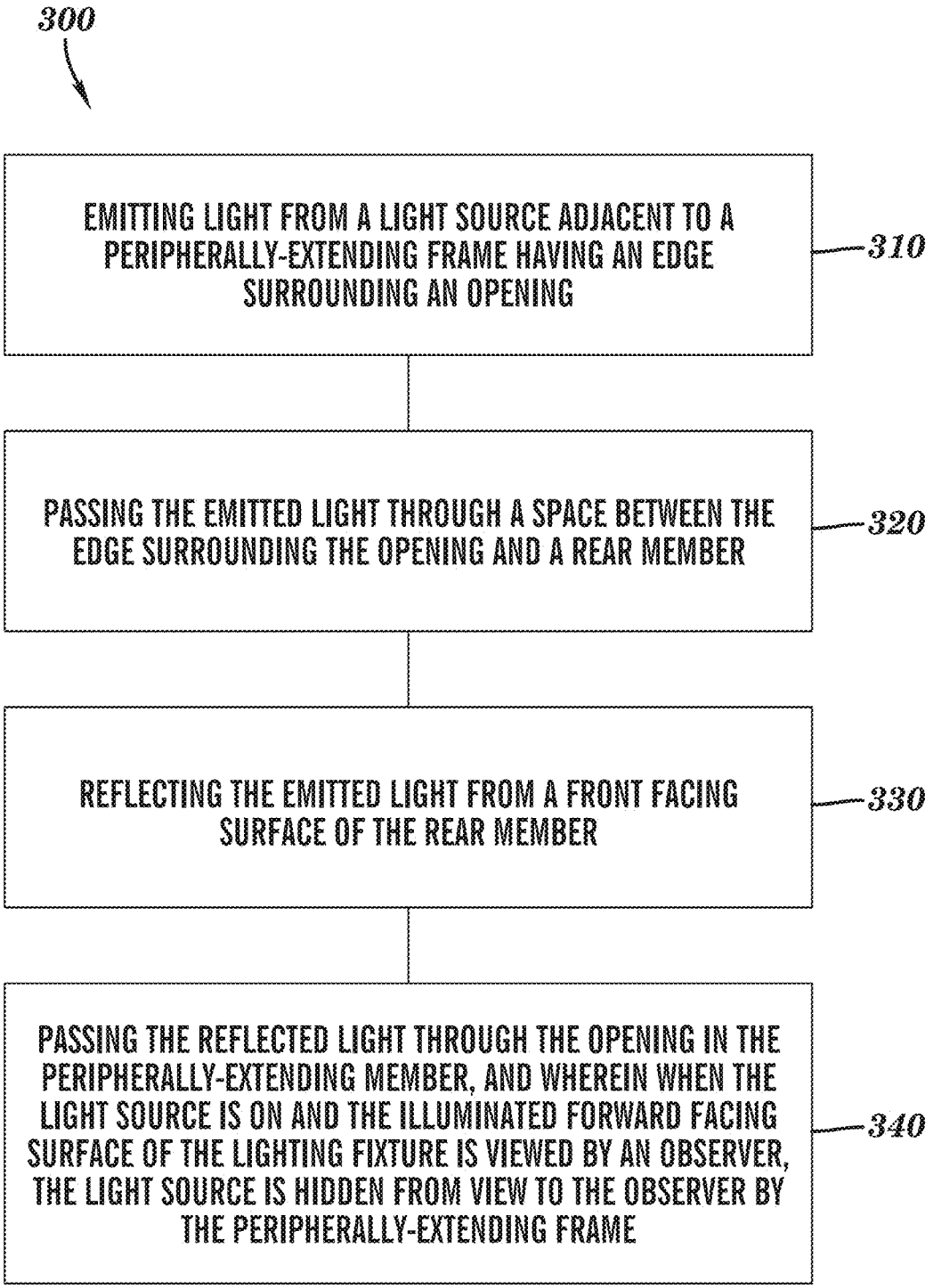
FIG. 20 is a method according to an embodiment of the present disclosure.

FIG. 20 illustrates a method 300 such as for operating a light fixture or illumination according to an embodiment of the present disclosure. For example, method 300 may include at 310 emitting light from a light source adjacent to a peripherally-extending frame having an edge surrounding an opening, at 320 passing the emitted light through a space between the edge surrounding an opening and a rear member, at 330 reflecting the emitted light from a front facing surface of the rear member, and at 340 passing the reflected light through the opening in the peripherally-extending member and wherein when the light source is on and the illuminated front facing surface of the lighting fixture is viewed by an observer, the light source is hidden from view to the observer by the peripherally-extending frame.

It is to be understood that the above description is intended to be illustrative, and not restrictive. For example, the above-described embodiments and/or aspects thereof may be used in combination with each other. In addition, many modifications may be made to adapt a particular situation or material to the teachings of the various embodiments without departing from their scope.

While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the disclosure has been described in detail in connection with only a limited number of embodiments, it should be readily understood that the disclosure is not limited to such disclosed embodiments. Rather, the disclosure can be modified to incorporate any number of variations, alterations, substitutions, or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

This written description uses examples in the present disclosure, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A lighting fixture comprising:

a peripherally-extending frame surrounding an opening, said peripherally-extending frame comprising a front member surrounding said opening comprising a front opening, and a rearwardly-extending member extending behind said front member, said rearwardly-extending member having a rearward edge surrounding a rear opening disposed behind said front opening, said front member completely surrounds said front opening, and said rearwardly-extending member completely surrounds said rear opening;

a rear member having a front facing surface disposed behind and spaced from said opening, said rear member comprises an inwardly curved front facing surface, said rear member completely covers said rear opening, and a peripherally extending edge portion of said rear member is operably attached to said front member;

a light source disposed behind said peripherally-extending frame;

said front facing surface of said rear member being unilluminated by said light source when said light source is off;

said front facing surface of said rear member being illuminated by said light source when said light source is on so that light emission from said light source passes between said peripherally-extending frame and said front facing surface of said rear member, is reflected off said front facing surface of said rear member, and is directed through said opening in said peripherally-extending frame; and wherein when said light source is on and said illuminated front facing surface of said lighting fixture is viewed by an observer, said light source is hidden from view to the observer by said peripherally-extending frame.

2. The lighting fixture of claim 1 wherein said rear member comprises a concave front facing surface.

3. The lighting fixture of claim 1 wherein when said lighting source is on and said illuminated front facing surface of said lighting fixture is viewed by the observer, a portion of said front facing surface of said rear member comprises a greater light emission compared to the light emission from a remainder portion of said front facing surface of said rear member.

4. The lighting fixture of claim 1 wherein said rear member comprises a mirror like-reflective front facing surface.

5. The lighting fixture of claim 1 wherein an entire volume between said opening is vacant.

6. The lighting fixture of claim 1 further comprising an object disposed in front or in said lighting fixture.

7. The lighting fixture of claim 1 wherein an entire volume between said front opening and said rear opening is vacant.

8. The lighting fixture of claim 1 wherein a front surface of said rearwardly-extending member is disposed at an angle of about 60 degrees to about 80 degrees relative to a front surface of said front member.

9. The lighting fixture of claim 1 wherein said front member and said rearwardly-extending member comprise a monolithic structure.

10. The lighting fixture of claim 1 wherein said peripherally-extending frame comprises a ring-shaped configuration surrounding said opening comprising a round opening.

11. The lighting fixture of claim 1 wherein said peripherally-extending frame comprises an elongated configuration surrounding said opening comprising an elongated opening.

12. The lighting fixture of claim 1 wherein said peripherally-extending frame comprise a first color, and said front facing surface of said rear member comprises a second color different from said first color.

13. The lighting fixture of claim 12 wherein said rear member comprises a mirror like-reflective front facing surface.

14. A method comprising:

providing the lighting fixture of claim 12;

emitting light from the light source;

reflecting the emitted light from the front facing surface of the rear member; and passing the reflected light through the rear opening and the front opening.

15. The lighting fixture of claim 1 wherein said light source comprises a plurality of light emitting diodes.

16. The lighting fixture of claim 15 wherein said rear member comprises a mirror like-reflective front facing surface.

17. The lighting fixture of claim 1 further comprising one or more power supplies.

18. The lighting fixture of claim 1 further comprising a plurality of brackets for use in releasably attaching said lighting fixture in a wall or a ceiling.

19. A method comprising:

providing the lighting fixture of claim 1;

emitting light from the light source;

reflecting the emitted light from the front facing surface of the rear member; and passing the reflected light through the opening.

20. A method comprising:

providing a peripherally-extending frame completely surrounding an opening, the peripherally-extending frame comprising a front member completely surrounding the opening comprising a front opening, and a rearwardly-extending member extending behind said front member, the rearwardly-extending member having a rearward edge surrounding a rear opening disposed behind the front opening;

providing a rear member completely covering the rear opening, and a peripherally extending edge portion of the rear member being operably attached to the peripherally-extending front frame;

emitting light from a light source adjacent to the rearward edge surrounding the rear opening;

passing the emitted light through a space between the rearward edge surrounding the rear opening and the rear member;

reflecting the emitted light from an inwardly curved front facing surface of the rear member;

passing the reflected light through the opening in the peripherally-extending member; and wherein when the light source is on and the illuminated front facing surface of the lighting fixture is viewed by an observer, the light source is hidden from view to the observer by the peripherally-extending frame.

21. The method of claim 20 wherein when the lighting source is on and the illuminated front facing surface of the lighting fixture is viewed by the observer, a portion of the front facing surface of the rear member comprises a greater light emission compared to the light emission from a remainder portion of the front facing surface of the rear member.

* * * * *